US009448533B2

(12) United States Patent
Bertrand et al.

(10) Patent No.: US 9,448,533 B2
(45) Date of Patent: Sep. 20, 2016

(54) BARREL SHAFT FOR A CLOCK MOVEMENT, BARREL SPRING AND BARREL INCLUDING SUCH A SPRING AND/OR SUCH A SHAFT

(71) Applicant: ROLEX SA, Geneva (CH)

(72) Inventors: Jean-Louis Bertrand, Feigères (FR); Albert Bortoli, Courtedoux (CH); Thomas Gyger, Le Fuet (CH); Vincent Von Niederhäusern, Courrendin (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/390,699

(22) PCT Filed: Apr. 4, 2013

(86) PCT No.: PCT/EP2013/057064

§ 371 (c)(1),
(2) Date: Oct. 3, 2014

(87) PCT Pub. No.: WO2013/150086

PCT Pub. Date: Oct. 10, 2013

(65) Prior Publication Data

US 2015/0092523 A1 Apr. 2, 2015

(30) Foreign Application Priority Data

Apr. 4, 2012 (EP) ..... 12002440

(51) Int. Cl.
*G04B 1/14* (2006.01)
*G04B 1/16* (2006.01)
*G04B 1/18* (2006.01)

(52) U.S. Cl.
CPC . *G04B 1/14* (2013.01); *G04B 1/16* (2013.01); *G04B 1/18* (2013.01)

(58) Field of Classification Search
CPC ..... G04B 1/14; G04B 1/16; G04B 1/18
USPC ..... 368/144
See application file for complete search history.

(56) References Cited

U.S. PATENT DOCUMENTS 381,176 A * 4/1888 Sedgwick ..... 368/144
1,110,061 A * 9/1914 Kienzle ..... 368/142

(Continued)

FOREIGN PATENT DOCUMENTS

| | | | |
|---|---|---|---|
| CH | 24783 | A | 2/1903 |
| CH | 295135 | A | 12/1953 |
| CH | 566044 | A | 8/1975 |
| CH | 703796 | B1 | 3/2012 |
| DE | 471680 | C | 2/1929 |

(Continued)

OTHER PUBLICATIONS

International Search Report for PCT/EP2013/057064, mailing date of May 24, 2013.

*Primary Examiner* — Vit W Miska
(74) *Attorney, Agent, or Firm* — Westerman, Hattori, Daniels & Adrian, LLP

(57) ABSTRACT

The invention relates to a barrel spring (2) including: an inner end (5) and an outer end; a first portion (50) having a first height (H); a second portion (52) having a second height (h) that is smaller than the first height (H) and being located near the inner end (5); and, at the second portion, e.g. at the inner end, a first attachment element (51) suitable for being attached to the barrel shaft, wherein the second portion is to be inserted into a circumferentially extending groove provided on the barrel shaft.

12 Claims, 5 Drawing Sheets

(56) References Cited

U.S. PATENT DOCUMENTS

| | | | | |
|---|---|---|---|---|
| 1,435,642 | A * | 11/1922 | Horn | 368/144 |
| 3,846,974 | A * | 11/1974 | Giger | 368/144 |
| 9,033,573 | B2 * | 5/2015 | Kaelin et al. | 368/142 |
| 2013/0133788 | A1 | 5/2013 | Aljerf et al. | |

FOREIGN PATENT DOCUMENTS

| | | | |
|---|---|---|---|
| DE | 612146 | C | 10/1935 |
| DE | 859698 | C | 12/1952 |
| GB | 1148042 | A | 4/1969 |
| WO | 2012010941 | A1 | 1/2012 |

* cited by examiner

BARREL SHAFT FOR A CLOCK MOVEMENT, BARREL SPRING AND BARREL INCLUDING SUCH A SPRING AND/OR SUCH A SHAFT

The invention relates to a clock movement barrel shaft or a shaft for a clock movement barrel. It also relates to a clock movement barrel spring or a spring for a clock movement barrel. It further relates to a barrel including such a shaft and/or such a spring. It finally relates to a clock movement or a timepiece, notably a wristwatch, including such a shaft and/or such a spring.

The Professional Illustrated Dictionary Of Clockmaking ("Dictionnaire Professionnel Illustré de l'Horlogerie") describes a classic construction of a barrel shaft for attaching a barrel spring. The shaft supports the drum and the cover of the barrel: bearing surfaces immobilize the drum and the cover in the axial direction and contact between the shaft, the drum and the cover allows pivoting of the drum about the shaft. The shaft further includes a cylindrical middle portion known as the core that is provided with a hook to which the barrel spring is attached by means of a rectangular opening (known in French as a "pigeonneau") near the interior end of the spring.

The clock barrel must provide two apparently contradictory functions: on the one hand, supplying the energy necessary for driving the finishing wheels and for maintaining oscillation of the balance-hairspring by unwinding of the spring and, on the other hand, allowing winding of the same spring at any time. The cover and the drum must be able to pivot on the shaft to ensure correct functioning of the barrel.

Indeed, the barrel shaft is connected to a ratchet and rotation of the ratchet (driven by the winding system and/or the automatic system) enables winding of the spring, which is fastened to the shaft. The unwinding of the spring drives the drum and the cover as well as the finishing wheels that lead to the escapement and to the oscillator. The drum and the cover must therefore be able to pivot on the shaft, which must itself be able to pivot in a jewel bearing. This is not at all straightforward in practice, and is generally achieved by a staggered construction of the barrel shaft, with a succession of cylindrical surfaces with increasing diameters that define bearing surfaces, forming with the jewel bearings pivot surfaces for the pivoting of the shaft, with the drum and the cover, and finally a diameter for fastening the spring to the shaft.

A similar construction is known from the document CH295135. In a classic arrangement of this kind, the core diameter cannot be reduced for structural reasons. Indeed, the shaft must provide for pivoting and axial retention of the drum and the cover. Moreover, a ratchet is mounted on a square on the shaft, generally by means of a screw and a corresponding screwthread in the shaft. This classic construction makes it obligatory to stagger and therefore to increase the diameters of the barrel shaft, starting from the lower and upper ends of the shaft and as far as the core diameter.

Fixing the barrel spring by inserting the internal end of the spring in an opening provided in a spring fixing structure produced in the wall of a tube serving as the barrel shaft is known from the document GB1148042. The internal end of the barrel spring is deformed to cooperate with the fixing structure. A shaft has a square conformation adapted to cooperate with square bores provided in the barrel wheel and in the fixing structure. This solution leads to high mechanical deformation of the end of the barrel spring, which is not the optimum.

Fixing a barrel spring to a shaft by friction, with an opening of particular shape at the end of the spring to enable winding without increasing the thickness, is known from the document CH295135. The diameter of the attachment is then more or less equivalent to the diameter of the shaft, ignoring the additional thickness of one turn. This type of attachment with no mechanical connection is a priori relatively unreliable.

Attaching the spring by inserting the bent interior end of the spring into a longitudinal groove formed in the shaft is known from the document CH566044. This solution also leads to high mechanical deformation of the end of the spring, which is not the optimum.

Thus there is no known solution for fastening a barrel spring to a barrel shaft reliably, industrially, demountably and without severe plastic deformation of the spring and providing the possibility of minimizing the core diameter without having to modify the standard arrangement of the barrel, and in particular the pivoting of the drum and the cover on the shaft.

In another technical field very different from the clockmaking field, that of cameras, the document DE 859698 describes a camera barrel. The teachings of that document are not applicable to the problem of a clock barrel spring. In fact, with the barrel described in the above document it is not possible to maximize the space available for the spring and the construction used cannot be employed to produce a barrel with its cover and its drum, for the following reasons:

- The document gives no indication concerning the placement of the drum and the cover, which must be able to pivot on the shaft. A traditional construction can therefore not be obtained based on the solution described in the document.
- Additionally, this type of construction does not enable the user to wind the barrel while the camera is operating, which is a fundamental requirement for a clock barrel.

The object of the invention is to provide a barrel shaft or a barrel spring eliminating the drawbacks referred to above and improving on the barrel shafts or the barrel springs known from the prior art. In particular, the invention proposes a barrel shaft enabling reliable, industrial and demountable fixing, without severe plastic deformation of the spring, as well as providing the possibility of minimizing the core diameter without having to modify the standard arrangement of the barrel.

A spring according to the invention includes:

- an interior end and an exterior end,
- a first portion (having a first height (H),
- a second portion having a second height (h) less than the first height (H) and situated near the interior end, and
- in the second portion, for example at the interior end, a first attachment element adapted to be fixed to a barrel shaft, the second portion being intended to be inserted in a groove extending circumferentially on the barrel shaft.

Various aspects of the spring are as follows:

- The first attachment element has a maximum height (h') such that max(h', h)<H, in particular such that H>h'>h.
- The first attachment element is intended to cooperate with a second attachment element on the shaft.
- The first attachment element has a trapezoidal or substantially trapezoidal conformation.
- The spring is made from a high-performance metal alloy, notably an amorphous metal alloy or a high-nitrogen alloy.

A shaft according to the invention includes a groove extending round a circumference of the shaft and intended to receive a barrel spring.

Various aspects of the shaft are as follows:

The groove is a staggered groove.

The groove has a height comparable to the second height of the spring.

The groove extends partly round the shaft, notably more than 180° round the axis of the barrel shaft, in particular round all the circumference of the barrel shaft.

The groove includes at least one portion the height of which is less than the height of an active part of the barrel spring.

The grove has a depth (p) at least locally greater than or equal to the thickness of the barrel spring or even a depth greater than or equal to the thickness of the barrel spring over all the extent of the groove.

The groove has a depth (p) equal or substantially equal to the thickness of the barrel spring.

The shaft includes in the groove, in particular at the bottom of the groove, a second attachment element for attaching the barrel spring, the second attachment element being intended to cooperate with a first attachment element on the barrel spring.

The second attachment element includes a protuberance, for example a hook, or a particular conformation of the groove or a recess in the groove.

The particular conformation of the groove includes a circumferentially oriented trapezoidal portion of the groove.

A barrel according to the invention includes a shaft as above and/or a spring as above.

A movement according to the invention includes a shaft as above and/or a spring as above and/or a barrel as above.

A watch according to the invention includes a shaft as above and/or a spring as above and/or a barrel as above and/or a clock movement as above.

The appended drawings represent embodiments of a barrel according to the invention by way of example.

A first embodiment of a barrel 4 according to the invention is described hereinafter with reference to FIGS. 1 to 3. The barrel primarily comprises a barrel shaft 1, a barrel spring 2, a barrel drum 3*a* and a barrel cover 3*b* (which is not represented in FIG. 3).

The drum barrel includes teeth for driving the wheels of a clock mechanism, notably a wristwatch mechanism. The barrel stores the mechanical energy necessary for the clock mechanism to operate. This energy is stored in the form of elastic potential energy, because of the deformation of the spring. Indeed, the spring is a blade spring coiled up round the shaft inside the drum, the spring being mechanically connected to the shaft at its interior end 5 and mechanically connected to the drum at its exterior end. When the spring is completely wound, it is coiled up on the shaft and is able to drive rotation of the drum relative to the shaft. The spring is represented in the unwound state in FIG. 3, the spring being coiled up on itself inside the diameter of the drum. In this configuration the spring is not able to drive rotation of the drum. To wind the spring, it suffices to drive rotation of the shaft about its axis.

Figure 2:
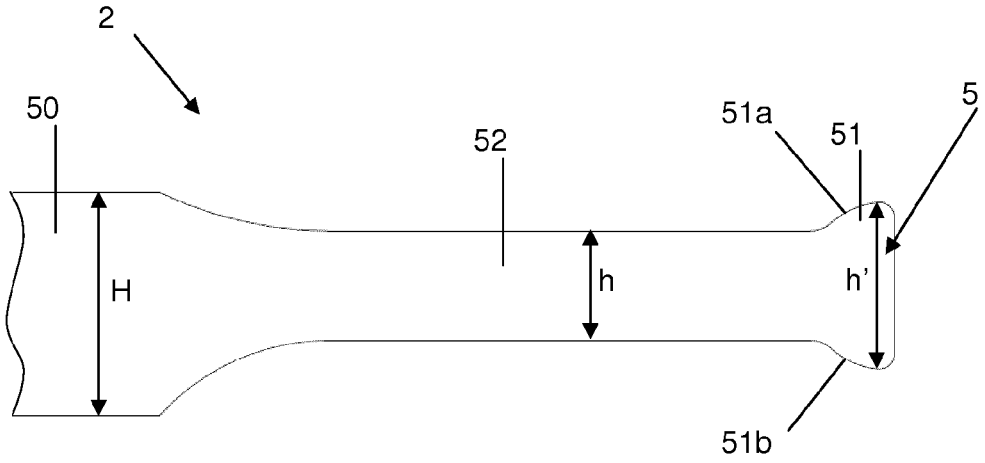
FIG. 2 is a partial view of a first embodiment of a barrel spring according to the invention.

Part of a first embodiment of a barrel spring 2 is represented in FIG. 2. It includes a first portion 50 (or active part) that has a first height H and a second portion 52 that has a second height h less than the first height. It also includes in the second portion, for example at the interior end, a first attachment element 51 for fixing it to the barrel shaft 1. The first attachment element has a maximum height h'. The second portion is intended to be inserted into a circumferential groove on the barrel shaft. By "circumferential" is meant that the groove extends over at least part of the circumference of the shaft. The groove has a depth p.

The first attachment element 51 is advantageously designed to cooperate with a second attachment element 13*a* on the shaft.

The first attachment element may have a trapezoidal or substantially trapezoidal conformation 51*a*, 51*b* delimited by edges 51*a*, 51*b*. For example, the two bases of the trapezoidal shape are oriented in or substantially in the heightwise direction of the spring. Moreover, the trapezoidal shape is preferably symmetrical or substantially symmetrical.

The second portion can be produced by machining the interior end of the spring, for example by mechanical cutting, milling, stamping, laser machining or waterjet cutting. Before this machining step is carried out, the spring advantageously consists of an elastic strip of constant height H.

A first embodiment of a barrel shaft is described hereinafter with reference to FIG. 1. It includes a groove 13 extending round a circumference of the shaft and this groove is intended to receive the barrel spring 2.

The shaft is a solid shaft. It preferably includes on either side of the groove shoulders 12 and 14 and bearing surfaces 11 and 15. The cylindrical portion 11 and the cylindrical portion 15 allow rotation of the drum and the cover of the barrel on the barrel shaft.

The shoulder 12 prevents axial movement of the drum. The shoulder 14 prevents axial movement of the cover. The two shoulders ensure the movement of the barrel casing (assembled cover and drum) relative to the shaft.

The groove advantageously has a height comparable to the second height h of the spring. Thus the groove includes at least one portion the height of which is less than the height of the active part of the barrel spring and the second portion 52 of the spring can be wound into the groove on the shaft. The section of the shaft in the groove is preferably circular and centered on the axis of the shaft. However, the envelope of the section of the shaft can also have a spiral shape the pitch of which is equal or substantially equal to the thickness of the spring. The length of the second portion can correspond to the length of a complete turn wound onto the shaft. As well as or instead of this, the groove has a depth at least locally greater than or equal to the thickness of the barrel spring, or even a depth greater than or equal to the thickness of the barrel spring over all of the extent of the groove, or even a depth equal or substantially equal to the thickness of the barrel spring.

The groove can extend round only part of the circumference of the shaft. The groove can notably extend more than 180° round the axis of the barrel shaft. The groove can also preferably extend round all the circumference of the barrel shaft. In both cases, the groove bottom radius can evolve, i.e. the groove bottom radius at a point on the bottom of the groove may have a value varying with the circumferential position of that point.

The shaft includes, in the groove, in particular at the bottom of the groove, a second element 113*a* for attaching the barrel spring, the second attachment element being intended to cooperate with the first attachment element 51 provided on the barrel spring.

Figure 1:
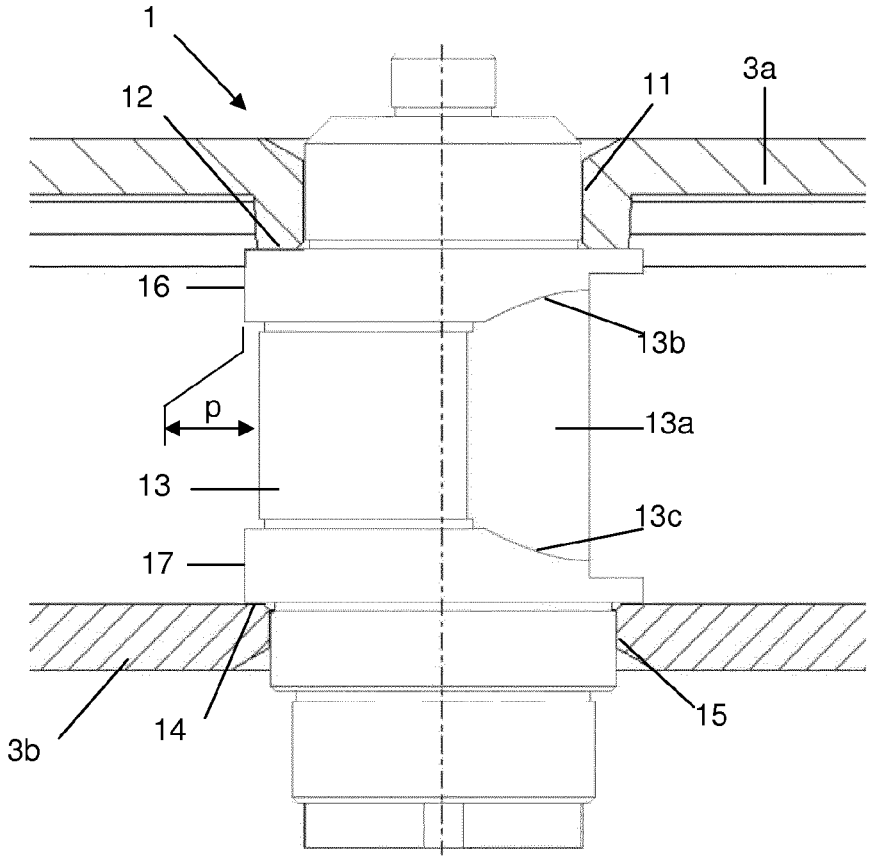
FIG. 1 is a view of a first embodiment of a barrel shaft according to the invention.
Figure 3:
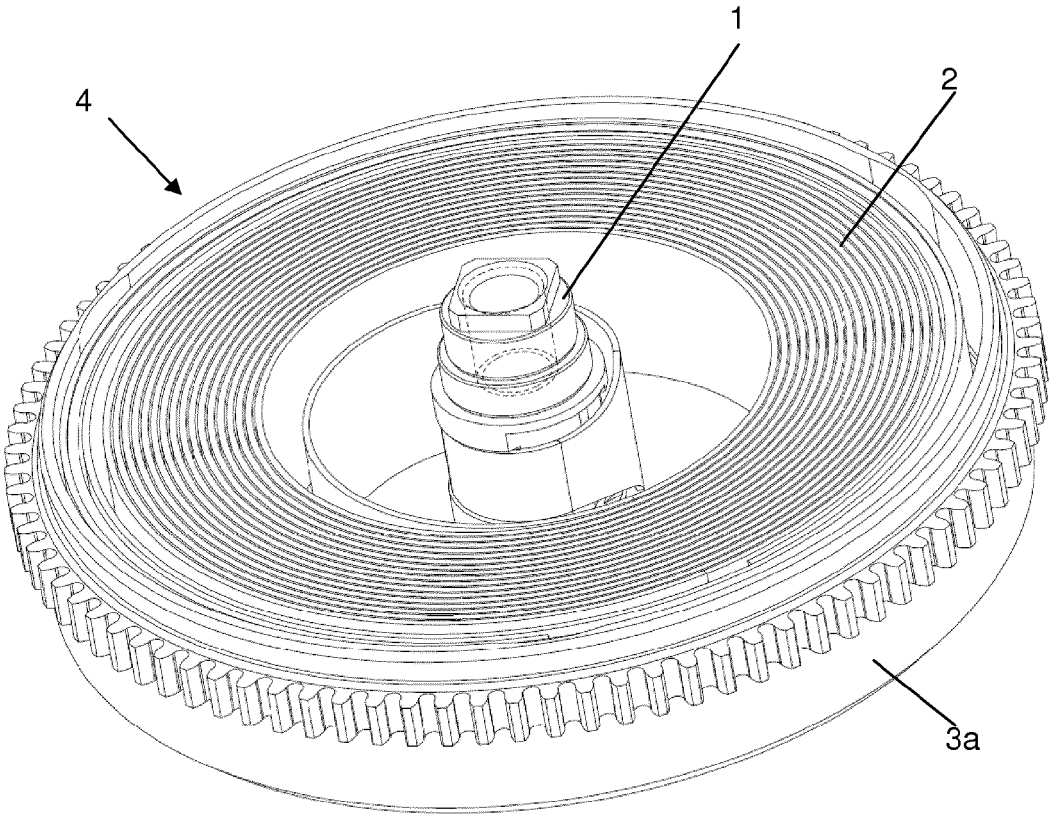
FIG. 3 is a perspective view of a barrel including a shaft according to the first embodiment and a spring according to the first embodiment.

In FIGS. 1 to 3 the second attachment element has a hollow conformation comprising edges 13*b* and 13*c* intended to cooperate with the trapezoidal conformation 51*a*, 51*b* of the spring. Indeed, the edges 13*b* and 13*c* come into contact with the edges 51*a* and 51*b*. Because of the trapezoidal shape and depending on the angle of the edges 13*b* and 13*c*, wedging of the end of the spring on the shaft may even occur. The trapezoidal shapes 13*a* and 51 are preferably oriented circumferentially.

The second portion 52 of the spring is preferably a non-active part, that is to say a part that does not contribute at all or very much to the torque developed by the spring, that is to say a part that is not or not greatly mechanically loaded in bending.

The groove therefore preferably has, at its bottom, a diameter less than the outside diameter of the shoulder 12 for immobilizing the drum of the barrel and/or less than the outside diameter of the shoulder 14 for immobilizing the cover of the barrel.

Portions (or cores) 16 and 17 are provided on respective opposite sides of the groove 13 to receive the wound turns of the first spring portion (50).

The first and second attachment elements are designed to minimize the core diameter. The number of development turns of the spring and therefore the power reserve of the barrel can hence be increased effectively without increasing the exterior volume of the barrel or modifying the gear ratio. This diameter reduction is therefore achieved by making a groove on the shaft that advantageously has a height comparable to the second height h of the spring with a step in the diameter less than that of the shoulders necessary for immobilizing the drum and cover. The interior end of the spring is cut with a lower strip height over a length more or less equivalent to that of the first turn, in order to increase the number of winding turns and therefore the power reserve.

To reduce the core diameter, the groove is machined in the shaft and includes an attachment part, notably a step serving as a female attachment part. The shape of the internal end of the spring must be adapted accordingly, by cutting a bracket lower than the rest of the blade spring that allows the first turn to be inserted in the groove, with a dovetail-shaped end part that serves as a male attachment part. By swaging this internal end, or using some other appropriate technique, an eye is produced the first turn of which has an inside diameter less than the groove machined in the shaft. This promotes the attachment of the strip to the shaft by a clamping action. The eye of the spring comprises one turn, in the particular instance represented over a height reduced to 0.9 mm relative to the 1.46 mm height of the first portion. This eye is pressed against the groove machined in the shaft provided with the step 13*a* for attaching the dovetail 51, 51*a*, 51*b* of the spring. On turning, rotation of the spring on the shaft is blocked thanks to the step and to its clearance angle. After the first turn, the spring portion is active and its height increases to 1.46 mm.

This solution firstly makes it possible to reduce the core diameter considerably. Compared to a standard barrel shaft for a small size movement (movement diameter approximately 20 mm), the core diameter is reduced from 1.85 mm to 1.39 mm, a reduction of 25%.

This reduction of the core diameter makes it possible to increase the performance of the barrel, and in particular the autonomy or the power reserve. In fact, for the same length of the spring, the smaller the core diameter the greater the possible number of turns when winding the blade spring. The greater the number of turns that the spring forms on the shaft in the wound state for a given length, the greater the autonomy. Indeed, the effect of a reduction in the core diameter on the increase in the number of turns is approximately of the second order.

Moreover, manufacture of the shaft is facilitated thanks to the elimination of the hook or the catch and the change from a core of varying diameter to a circular groove that can be machined on a lathe. Machining the step for the attachment of the end is simple to effect by means of an angle (or dovetail) milling tool. The radial and longitudinal bearing surfaces on the shaft for the cover and the drum are made in the traditional manner and the how the barrel is assembled into the clock movement remains traditional. More particularly, the longitudinal movement of the drum and the cover is defined by the shoulders 12 and 14 of the shaft while the longitudinal movement of the barrel relative to the ebauches is also achieved by means of shoulders, here by shoulders adjacent the shoulders 12 and 14.

The attachment elements also have undeniable advantages for assembling the spring onto the barrel shaft. The radius of curvature of the interior turn of the spring before fitting is always less than the core radius, so as to guarantee good pressure on and clamping of the spring onto the shaft and adequate fixing. With a traditional construction, the lower end of the spring must be opened a first time to pass over the bearing surface and place the spring on the core. A second step of opening the spring is then required to move it away from the shaft to allow it to pass over the catch on sliding it downwards. Moreover, given the lack of vertical guiding of the blade spring, the eye must be placed precisely facing the catch to ensure correct attachment of the spring to the shaft.

With the spring and the shaft according to the invention, it suffices to move the spring away from the shaft to pass it over the bearing surface of the core and then to slide the spring downwards. Vertical positioning is achieved by inserting the portion of reduced height into the groove 13. To effect the attachment, the shaft is rotated in the driving (winding) direction of the spring and the dovetail end takes up its position and is attached to the step 13*a* provided for this purpose, reliably and reproducibly whatever the initial orientation of the end of the spring relative to the attachment on the shaft. This greatly facilitates assembling the spring onto the shaft. Thus a dovetail (eagle-tail) type fixing enables correct positioning of a spring incorporating an eye with no manipulation other than slightly opening the internal turn or winding of the spring to pass it over the bearing surface 12 or 14, after which the shaft is rotated to clip the trapezoidal portion of the spring to the corresponding part of the shaft.

Figure 4:
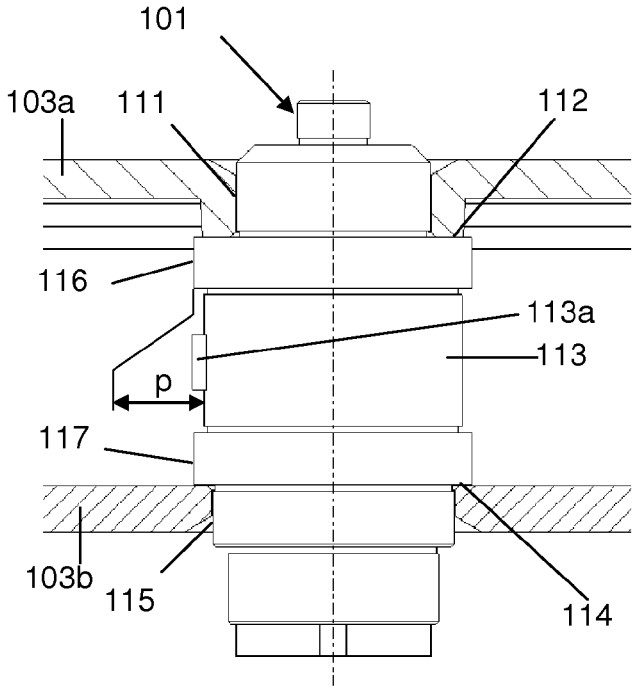
FIG. 4 is a view of a second embodiment of a barrel shaft according to the invention.
Figure 5:
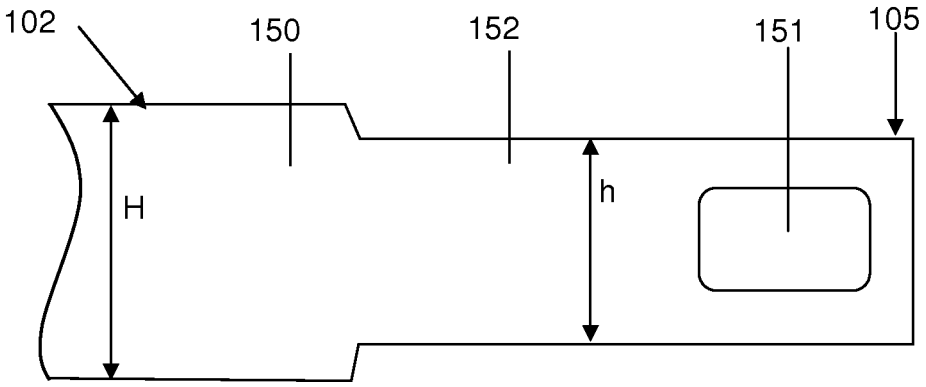
FIG. 5 is a partial view of a second embodiment of a barrel spring according to the invention.

A second embodiment of a barrel shaft according to the invention and a second embodiment of a barrel spring according to the invention are described hereinafter with reference to FIGS. 4 and 5.

In the illustration of this second embodiment, elements that are identical or similar to or have the same function as those of the first embodiment have reference numbers increased by one hundred. For example, the shaft of the second embodiment and the spring of the second embodiment are referenced "101" and "102" whereas the shaft of the first embodiment and the spring of the first embodiment are referenced "1" and "2".

The second embodiment differs from the first embodiment only in terms of the first attachment element 151 and the second attachment element, the first attachment element and the second attachment element being designed to cooperate with each other.

In the second embodiment, a catch or hook 113*a* is produced on the shaft at the bottom of the groove 113.

Production of such a catch or hook is relatively complicated.

The catch or the hook cooperates with an opening ("pigeonneau" in French) 151 produced at the end 105 of the spring. The opening is substantially rectangular, for example. The catch or the hook is conformed to be inserted in this opening.

The shaft pivots in a jewel bearing at its upper end. As represented in FIG. 4, the drum 103*a* for its part pivots on the shaft at the level of the portion 111 and the bearing surface 112, while the cover 103*b* does likewise on the portion 115 and the bearing surface 114.

Figure 6:
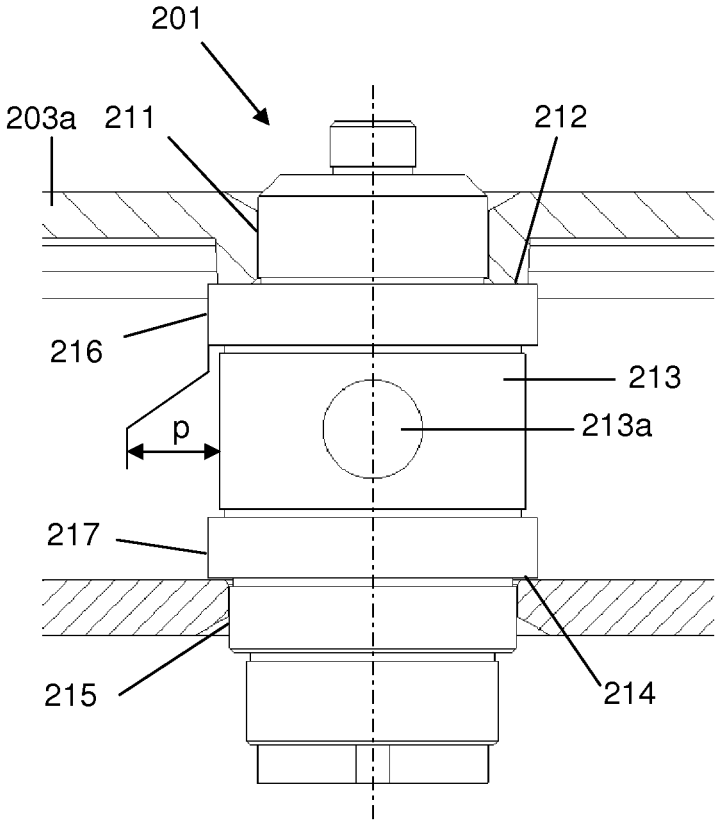
FIG. 6 is a view of a third embodiment of a barrel shaft according to the invention.
Figure 7:
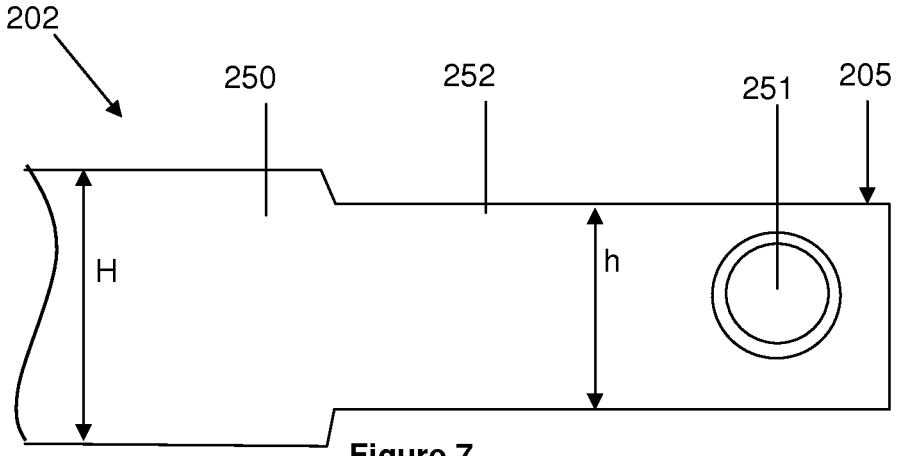
FIG. 7 is a partial view of a third embodiment of a barrel spring according to the invention.

A third embodiment of a barrel shaft according to the invention and a third embodiment of a barrel spring according to the invention are described hereinafter with reference to FIGS. 6 and 7.

In the illustration of this third embodiment, elements that are identical or similar to or have the same function as those of the first embodiment have reference numbers increased by two hundred. For example, the shaft of the third embodiment and the spring of the third embodiment are referenced "201" and "202" whereas the shaft of the first embodiment and the spring of the first embodiment are referenced "1" and "2".

The third embodiment differs from the first embodiment only in terms of the first attachment element 251 and the second attachment element 213*a*, the first attachment element and the second attachment element being designed to cooperate with each other.

In the third embodiment, a cut-out 213*a* is produced in the shaft at the bottom of the groove 213, for example by a bore. This cut-out is perpendicular to the axis of the shaft, for example.

The cut-out cooperates with a pin 251 fixed to the end 205 of the spring. The pin may notably be riveted to the spring.

This solution necessitates an additional component but makes it possible to simplify the production of the shaft.

Figure 8:
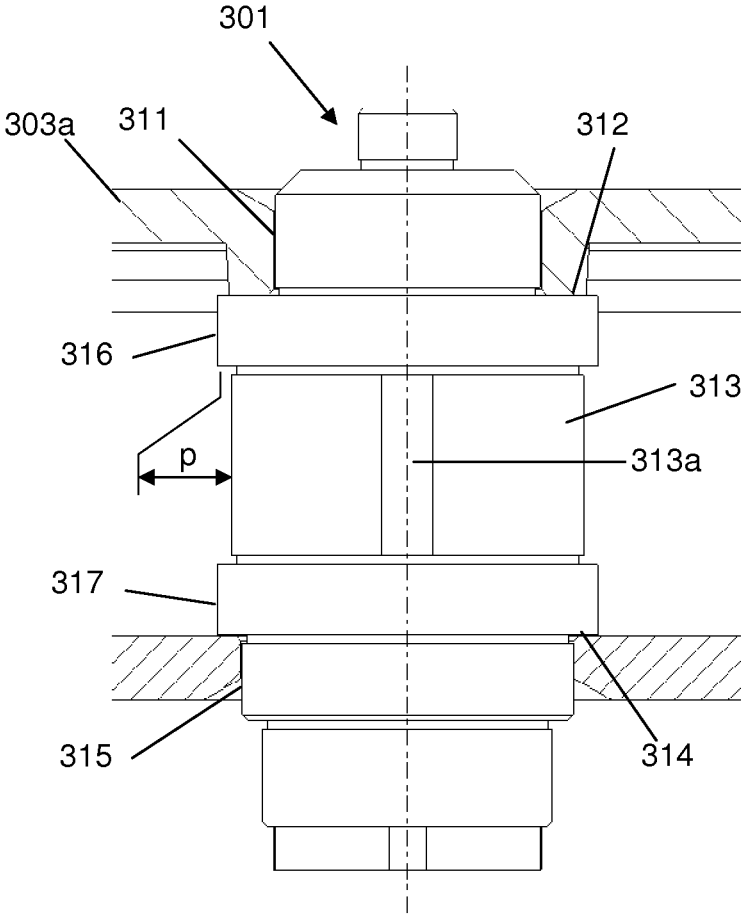
FIG. 8 is a view of a fourth embodiment of a barrel shaft according to the invention.
Figure 9:
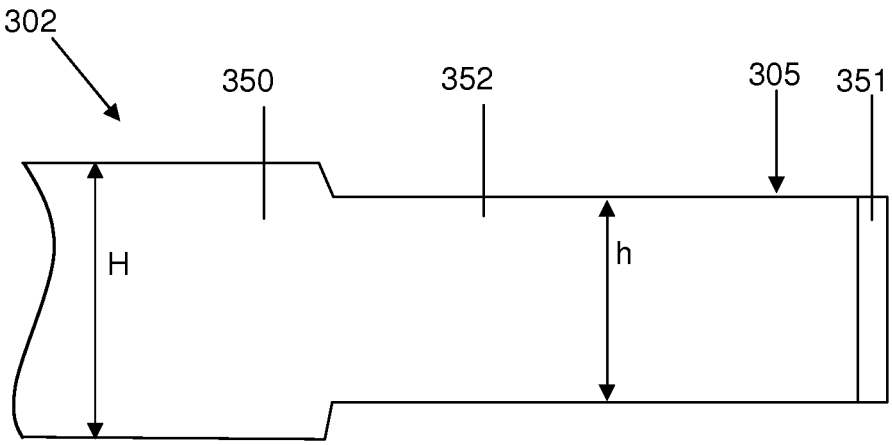
FIG. 9 is a partial view of a fourth embodiment of a barrel spring according to the invention.

A fourth embodiment of a barrel shaft according to the invention and a fourth embodiment of a barrel spring according to the invention are described hereinafter with reference FIGS. 8 and 9.

In the illustration of this fourth embodiment, elements that are identical or similar to or have the same function as those of the first embodiment have reference numbers increased by three hundred. For example, the shaft of the fourth embodiment and the spring of the fourth embodiment are referenced "301" and "302" whereas the shaft of the first embodiment and the spring of the first embodiment are referenced "1" and "2".

The fourth embodiment differs from the first embodiment only in terms of the first attachment element 351 and the second attachment element 313*a*, the first attachment element and the second attachment element being designed to cooperate with each other.

In the fourth embodiment, a notch 313*a*, for example a radial notch, is produced in the shaft at the bottom of the groove 313.

The notch cooperates with a bent portion 351 at the end 305 of the spring.

In the various embodiments the second attachment element therefore includes a protuberance, for example a hook, or a particular conformation of the groove or a recess in the groove and the first attachment element includes an opening or a particular conformation of the interior end of the spring or a pin, notably a riveted pin.

In the various embodiments, the interior end of the spring forms a winding having dimensions, notably a diameter, such that the winding is deformed when it is mounted on the shaft.

In the various embodiments, the spring may be clipped or wedged onto the shaft or fixed in the traditional manner with a catch.

Attachment is preferably effected by means of a catch (male shape) cut out at the internal end of the blade spring retained by a corresponding female shape machined in the shaft. Such a system therefore interchanges the male and female parts of the fixing compared to the standard solution: the male part is moved from the shaft to the spring.

The spring according to the invention may in particular be made from a material of high mechanical strength, such as an amorphous metal alloy described in the application WO2012010941, for example. Nevertheless, traditional high-performance metal alloys such as super-alloys based on cobalt (Nivaflex, etc) or high-nitrogen alloys (CrMnN alloys as described in the document CH703796) may also be used. The sizing of the core diameter will nevertheless have to take account of the plastic deformation characteristics specific to the state of each material considered. Thus the improvement achieved thanks to the invention may be limited to some degree by the material chosen (and its work-hardened state in the case of polycrystalline materials). For this reason, the increase in performance noted with a barrel according to the invention will probably be more marked with a spring of the type described in the application WO2012010941 or in the document CH703796 than with a Nivaflex type spring.

Moreover, depending on the alloy used for the spring, it is also possible to reduce the groove diameter so that the catch 52 and the internal end of the spring make more than one turn on the shaft. In this case, only the first turn on the shaft is inactive and the active portion of the spring also includes a part of reduced height that can be inserted in the groove of the shaft.

Figure 10:
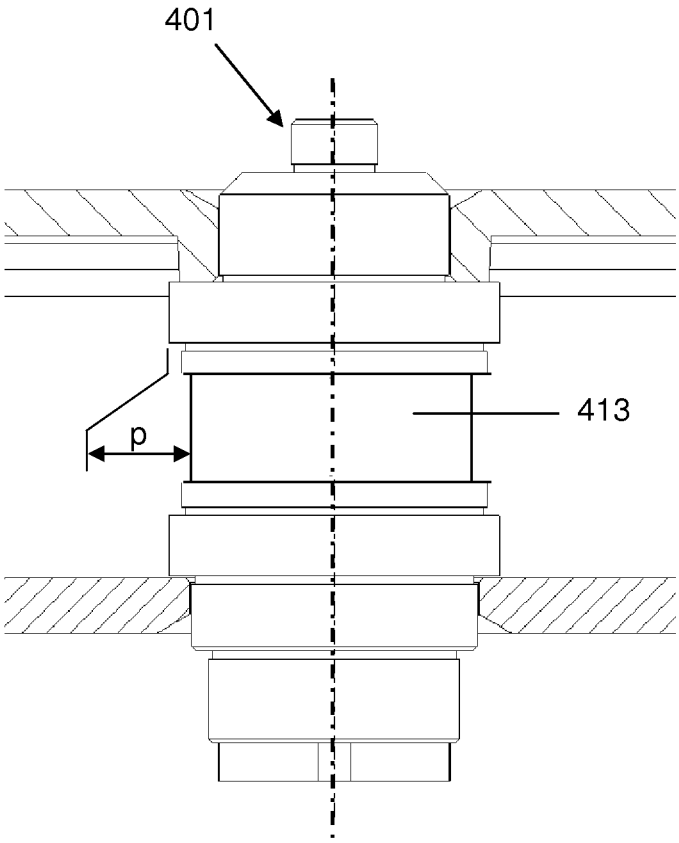
FIG. 10 is a view of a fifth embodiment of a barrel shaft according to the invention.

Accordingly, in a variant notably applicable to the various embodiments described above, a plurality of grooves, notably two grooves, may be formed on the shaft 401, as represented in FIG. 10. It is therefore possible to accommodate more than one spring coil, notably two spring coils, in these grooves. In this case, the spring coils intended to be accommodated in these grooves are different heights. The height of the coils may be progressively smaller towards the internal end of the spring. It is therefore possible to accommodate one coil, and preferably more than one coil, within an overall radial size defined by the diameter 16, 116, 216 or 316.

In other words, the shaft may include a groove 413 enabling more than one complete coil (or turn) of the spring to be accommodated therein. One or more coils of the spring can therefore be accommodated in the groove without this coil exceeding an overall radial size defined by the diameter 16, 116, 216 or 316. The groove may advantageously be staggered. In the case of a staggered groove, the groove may be seen as constituting a plurality of grooves of different depth, produced at the bottom of each other. This staggered groove makes it possible to accommodate more than one coil of the spring in the groove without exceeding an overall radial size defined by the diameter 16, 116, 216 or 316. In this case, the depth p of the groove is greater than the thickness of the spring.

A barrel according to the first embodiment has been compared with a standard barrel. The results are set out in the following table.

| Type | Development turns | Barrel autonomy [h] |
|---|---|---|
| Standard barrel, Nivaflex spring | 10.0 | 50 |
| Standard barrel, amorphous alloy spring | 12.0 | 60 |
| New attachment, amorphous alloy spring | 14.2 | 71 |

The barrel spring and/or the barrel shaft and/or the barrel according to the invention is/are particularly suitable for exploiting the exceptional mechanical properties of amorphous metal alloys. In fact, the barrel according to the invention enables an increase of two development turns with an amorphous metal alloy spring as described in the application WO2012010941. The combination of the barrel according to the invention and an amorphous metal alloy makes it possible to achieve a 40% increase in autonomy in the above example with exactly the same overall size of the barrel. For the above test, the blade springs were produced with identical spring lengths and an identical clamp. However, other factors such as the clamp, the shape of the eye and the length of the blade spring come into play and the system could be optimized by modifying parameters such as the length of the blade spring or the characteristics of the clamp.

In the various embodiments and variants described above, the maximum height h' of the first attachment element may advantageously be less than the height H of the first portion. The maximum height h' of the first attachment element may also advantageously be less than the distance between the bearing surfaces 12 and 14 of the barrel shaft that define the part on which the first portion of the spring comes to bear. Moreover, the maximum height h' of the first attachment element may advantageously be greater than the height h of the second portion of the spring and greater than the height of the groove 13 in the barrel shaft. The height of the spring over the first turn, including the end, may also advantageously be less than the height of the exterior part of the spring (in other words, max(h', h)<H where max(a, b) designates the greater of the values of the two parameters (a, b)). These various features, separately or in combination, make it possible to maximize the height available for the spring in a barrel structure with a cover and a drum.

In the various embodiments and variants described above, the depth p of the groove is preferably equal or substantially equal to the thickness of the spring. The depth of the groove may be greater than the thickness of the spring.

In the case of a first attachment element of dovetail (eagle-tail) shape as described for the first embodiment, the first attachment element includes a trapezoidal or substantially trapezoidal part. This trapezoidal part may have a height that decreases in the direction away from the internal end of the spring. For example, the trapezoidal part may have a height evolving in this direction from the maximum height h' to the height h. The spring therefore conforms to the following condition:

$$H>h'>h$$

This conformation of the first attachment element enables the spring to be fixed in the groove by simply rotating the shaft relative to the spring. The groove intended to receive the spring includes, by way of second attachment element, a housing or conformation or recess complementary or substantially complementary to the first attachment element.

In the various embodiments and variants described above, the second height h may evolve along the second portion.

The invention claimed is:

1. A barrel including a barrel shaft and a barrel spring, wherein the barrel spring includes:
- an interior end and an exterior end,
- a first portion having a first height (H),
- a second portion having a second height (h) less than the first height (H) and situated near the interior end, and
- in the second portion, a first attachment element adapted to be fixed to a barrel shaft, wherein the barrel shaft includes:
- a groove extending circumferentially on the barrel shaft, wherein the second portion is adapted to be inserted in the groove, wherein the first attachment element in the second portion is adapted to cooperate with a second attachment element on the barrel shaft, and wherein the first attachment element has a maximum height (h') such that max(h', h)<H.

2. The barrel as claimed in claim 1, wherein H>h'>h.

3. The barrel as claimed in claim 1, wherein the first attachment element has a trapezoidal or substantially trapezoidal conformation.

4. The barrel as claimed in claim 1, which is made from a high-performance metal alloy.

5. The barrel as claimed in claim 1, wherein the first attachment element is located at the interior end in the second portion.

6. The barrel as claimed in claim 4, wherein the high-performance metal alloy is selected from the group consisting of an amorphous metal alloy, a high-nitrogen alloy, and a super-alloy based on cobalt.

7. A watch including a barrel as claimed in claim 1.

8. A barrel including a barrel shaft and a barrel spring, wherein the barrel spring includes:
- an interior end and an exterior end,
- a first portion having a first height (H),
- a second portion having a second height (h) less than the first height (H) and situated near the interior end, and
- in the second portion, a first attachment element fixed to the barrel shaft, wherein the barrel shaft includes:

a groove extending circumferentially on the barrel shaft, wherein the second portion of the barrel spring is inserted in the groove of the barrel shaft, wherein the groove extends around an entire circumference of the barrel shaft, and the second portion of the barrel spring is inserted in the groove around the entire circumference of the barrel shaft.

9. The barrel according to claim 8, wherein a thickness of the barrel spring is equal or substantially equal to a depth of the groove.

10. A barrel including a barrel shaft and a barrel spring, wherein the barrel spring includes:

an interior end and an exterior end, a first portion having a first height (H), a second portion having a second height (h) less than the first height (H) and situated near the interior end, and in the second portion, a first attachment element adapted to be fixed to a barrel shaft, wherein the barrel shaft includes:

a groove extending circumferentially on the barrel shaft, wherein the second portion is adapted to be inserted in the groove, and wherein the first attachment element has a dovetail shape, the first attachment element including a trapezoidal or substantially trapezoidal part.

11. A barrel including a barrel shaft and a barrel spring, wherein the barrel spring includes:

an interior end and an exterior end, a first portion having a first height (H), a second portion having a second height (h) less than the first height (H) and situated near the interior end, and in the second portion, a first attachment element adapted to be fixed to a barrel shaft, wherein the barrel shaft includes:

a groove extending circumferentially on the barrel shaft, wherein the groove is staggered, wherein the second portion is adapted to be inserted in the staggered groove, and wherein the second portion is adapted to cooperate with the staggered groove to accommodate more than one coil of the spring in the staggered groove.

12. The barrel according to claim 11, wherein the groove is staggered in an axial direction of the shaft.

* * * * *